US005761853A

United States Patent [19]

Trosper et al.

[11] Patent Number: 5,761,853

[45] Date of Patent: Jun. 9, 1998

[54] DROPCLOTH

[75] Inventors: Stephen Trosper, 229 S.W. 2nd Pl., Gainesville, Fla. 32601; Frederick Taylor, Gainesville, Fla.

[73] Assignee: Stephen Trosper, Summerland Key, Fla.

[21] Appl. No.: 552,317

[22] Filed: Nov. 2, 1995

[51] Int. Cl.[6] ..... B62D 63/04; E04B 1/34; E04H 15/18; B65D 65/02

[52] U.S. Cl. ..... 52/3; 118/504; 135/97; 135/115; 150/154

[58] Field of Search ..... 118/504; 52/3, 52/4; 135/95, 97, 115, 900, 901, 902; 150/154, 155, 158, 165, 168; 427/272, 282

[56] References Cited

U.S. PATENT DOCUMENTS

| | | | |
|---|---|---|---|
| 3,537,688 | 11/1970 | Stein | 135/95 |
| 3,862,876 | 1/1975 | Graves | 161/44 |
| 3,872,549 | 3/1975 | Elyea | 24/73 B |
| 4,031,589 | 6/1977 | Couch | 15/115 |
| 4,194,678 | 3/1980 | Jasper | 206/427 |
| 4,606,070 | 8/1986 | Schachter | 383/4 |
| 4,632,138 | 12/1986 | Irwin | 135/109 |
| 4,682,447 | 7/1987 | Osborn | 52/3 |

*Primary Examiner*—Donald E. Ozaja
*Assistant Examiner*—Jacqueline A. Ruller
*Attorney, Agent, or Firm*—Saliwanchik, Lloyd & Saliwanchik

[57] ABSTRACT

An easily and quickly deployable device for protecting against soiling of non-workpiece items during painting of a workpiece is provided by a device having at least one rigid section and at least one flexible section. The rigid section also acts as a housing for the flexible section. The device is folded open to protect non-workpiece items during the painting operation.

17 Claims, 4 Drawing Sheets

DROPCLOTH

BACKGROUND OF THE INVENTION i. Field of the Invention

This invention relates to an easily and quickly deployable covering, or dropcloth, for use by painters to protect non-workpiece items against paint splatter while painting a workpiece.

ii. Background

Most aspects of paint technology have received considerable attention in the past, such that improved paint rollers, brushes, spray guns and other painting accessories are commercially available. However, in terms of protecting non-workpiece items against paint splatter, the state of technology has remained largely unchanged, with the standard solution being to drape a cloth, plastic, canvas or other type of sheet, such as the tarpaulin of U.S. Pat. No. 4,682,447, over non-workpiece items, particularly the floor. Unfortunately, this solution is not ideal as it is time consuming to spread these types of protective sheets, and frequently soiling of the floor occurs anyway as the soiled protective sheet folds over, or otherwise comes in contact with the floor. Items such as the portable drip collector of U.S. Pat. No. 4,031,589, and the drop cloth holder of U.S. Pat. No. 3,872,549, do not fully address the problems of paint splatter and only underscore the need for a more perfect solution.

What is needed, therefore, is an easily and quickly deployable and easily moved covering which overcomes these problems. This invention provides such a solution.

BRIEF SUMMARY OF THE INVENTION

An easily and quickly deployable dropcloth, referred to herein as the Quickdrop, for use in protection against soiling of non-workpiece items during painting of a workpiece, is provided by a device having interlocking rigid panels which slide into pockets formed in a protective fabric. The rigid panels within the fabric form a base and a housing for outwardly spreadable, pre-sewn protective flaps which extend from the rigid panels within the pockets. The flaps of the device fold inwardly. After folding the soiled protective sheeting or flaps onto the wet surface of the rigid panels, the panels may then be folded toward each other to provide a dropcloth that is easy to transport and which eliminates contact by soiled portions of the device with the floor or other non-workpiece items. Preferably, in the flaps which fold out, there are pre-sewn channels for insertion of rigid dowels to increase the maneuverability of the spread-out Quickdrop.

Accordingly, it is one object of this invention to provide an improved dropcloth for preventing paint splatter on non-workpiece items.

Another object of this invention is to provide a novel dropcloth which is quickly and easily deployed and moved during the painting process.

Another object of this invention is to provide a dropcloth having rigid panels within a protective fabric, fabric flaps which fold outwardly from the rigid panels, such that upon completion of a painting operation, the device can be folded onto itself, wet surface to wet surface, and thereafter be easily moved without the danger of soiling non-workpiece items.

Other objects and advantages of the invention will become readily apparent from a review of the complete disclosure.

DETAILED DESCRIPTION OF THE INVENTION

This invention provides a novel device useful to those wishing to paint a workpiece without splashing or otherwise soiling non-workpiece items such as the floor. The device, referred to herein as the Quickdrop, comprises at least one rigid central section, and at least one flexible flap extending therefrom. Preferably, the Quickdrop comprises two internal rigid quadrants, two flexible flaps extending therefrom, the external aspect of each of these flaps housing a rigid rod or like member. What follows is a detailed description of methods of making and using this device, including its best mode.

Figure 1A:
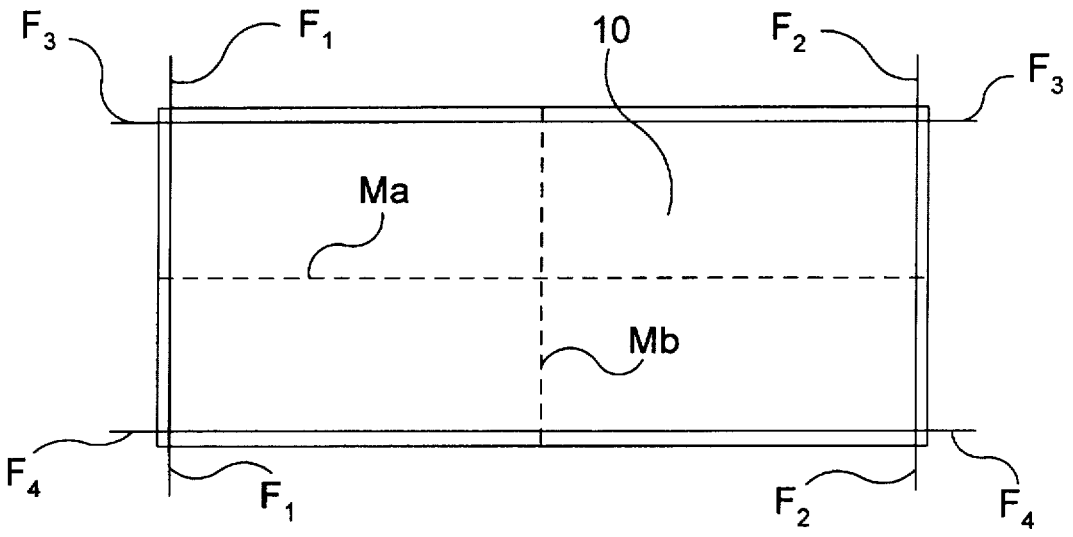
FIG. 1A shows a plan view of a piece of fabric with fold lines for preparation of the Quickdrop.

With reference to FIG. 1A, one method of making the device of this invention is disclosed. A piece of fabric 10 is cut to any desired dimensions. The term "fabric" should be understood to mean any type of cloth, plastic, fabric or like material which can be easily spread over the floor or a workpiece. Preferred materials for this purpose include plastic sheeting, canvas, woven tarpaulin material and the like. A commercially available material that is preferred is known as POLYDUCK (available from Reeves & Co., Durham, N.C.), which is a cotton or similar fabric with a liquid impermeable back coating.

For the purposes of the following description, preferred dimensions for the fabric 10 are provided, but it will be immediately recognized that the principles of this invention may be applied to any given dimensions. The dimensions provided are therefore only exemplary, but are preferred for preparation of a Quickdrop which is easily deployed for use in painting walls in residential or other buildings, (dimensions for a smaller version of the Quickdrop, referred to herein as the Minidrop or Closetdrop, which is adapted for use in closets and other confined spaces, are provided below). Accordingly, the fabric 10 of this example has dimensions of 146 inches (12 ft., 2 in.), in length, and 75 inches (6 ft., 3 in.) in width. Markings F1, F2, F3, and F4 indicate the points of making the first through fourth folds in the fabric, respectively. The marking Ma indicates the midpoint in the width dimension, and the marking Mb indicates the midpoint in the length dimension. Folds F1, F2, F3, and F4 preferably each use about 1.5 inches of material, and the flap created by folding over the material is sewn or otherwise affixed along the folded-over edge. The new dimensions of the cloth with edges sewn, as shown in FIG. 1B, would be 143 inches (11 ft., 11 in.) in length, and 72 inches (6 ft.) in width.

Figure 1B:
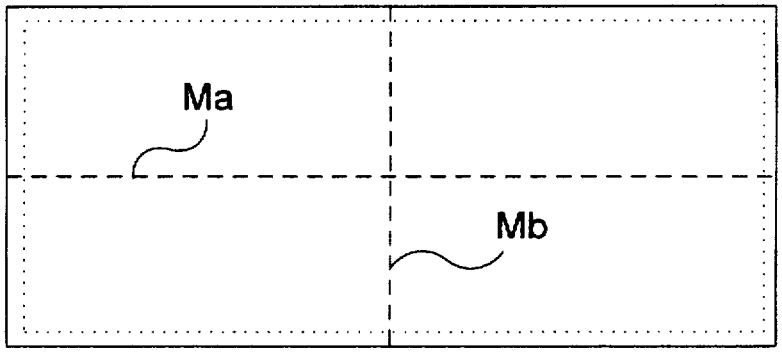
FIG. 1B shows a plan view of the same piece of fabric after the edges have been folded and sewn or otherwise fixed in place.
Figure 1C:
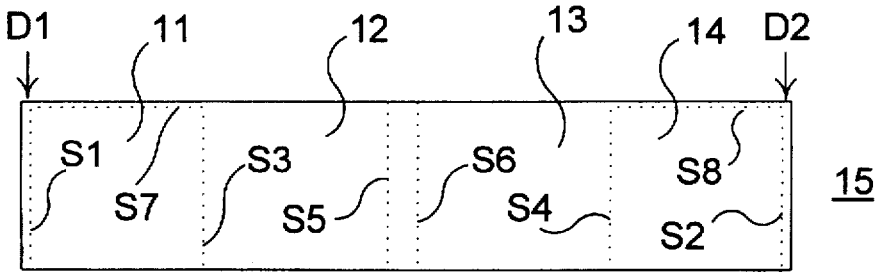
FIG. 1C shows a plan view of the same piece of fabric after pockets have been made by folding the fabric along its midline and affixing appropriate seams.

In FIG. 1C, the cloth of FIG. 1B has been folded over upon itself along the midpoint line Ma. Seams are now sewn or otherwise affixed (using Velcro, zippers, snaps or the like) in the material as follows: S1 and S2 are sewn or otherwise affixed vertically, about 1–2 inches in from either end. Horizontal seams S7 and S8 are sewn inward from seams S1 and S2, to a point about 36 inches in from each edge. At that same point, about 36 inches in from each edge, vertical seams S3 and S4 are sewn or otherwise affixed. Finally, seams S5 and S6 are sewn vertically, about 1 inch from each other, on either side of the midpoint line Mb. As a result of the foregoing operations, a segmented cloth having the following quadrants is created, with dimensions as follows: Quadrants 11 and 14, 36 in.×35 in.; quadrants 12 and 13, 36 in.×36 in. Quadrants 12 and 13 form pockets or slots into which flat, rigid members, described below, are inserted. Slots D1 and D2 have also been created with open ends for insertion of dowels. The dowels are preferably constructed of an inexpensive, light-weight but strong and rigid material. Wooden dowels, having a diameter of about 0.25 inches and a length of about 36 inches have been found adequate for this purpose. Naturally, other materials such as plastic rods, fiberglass, aluminum or like materials could be used for this purpose, and the diameter of the rod may be adjusted accordingly, depending on the strength and rigidity of the material used. With the seams sewn as described above, and the rods or dowels inserted into slots D1 and D2 as described, the partially assembled Quickdrop 15 of this invention is prepared.

While the foregoing description provides one method, using a single starting piece of fabric, for making the partially assembled Quickdrop 15 of this invention, it would be obvious to those skilled in the art, based on the foregoing disclosure, that a similar result could be achieved using obvious modifications on this method. Thus, the pocket quadrants 12 and 13 could be independently assembled and then attached to each other. Side flaps (quadrants 11 and 14) could likewise be independently prepared and then attached to the pocket quadrants, 12 and 13. In addition, obviously the pockets of quadrants 12 and 13 could be eliminated completely, and the rigid member described below could be simply affixed to the underside of fabric of appropriate dimensions. Thus, these alternate methods of making the invention come within the scope of the instant invention. In another preferred embodiment of this invention, additional flexibility of the Quickdrop is achieved if the quadrants are easily detached and reattached from and to each other. This is easily achieved by, for example, providing matching Velcro hook and loop material strips, zippers snaps, or the like along the edges of each quadrant. It should also be noted that to prevent soiling of the Quickdrop, such secondary items as a protective paper or plastic sheet with the appropriate dimensions could be easily attached to the surface of the Quickdrop prior to each painting operation and then disposed. This, however, is not required for operation of the Quickdrop for, even when the paint dries in the folded state of the Quickdrop, the quadrants can be quite easily pealed apart.

Figure 2A:
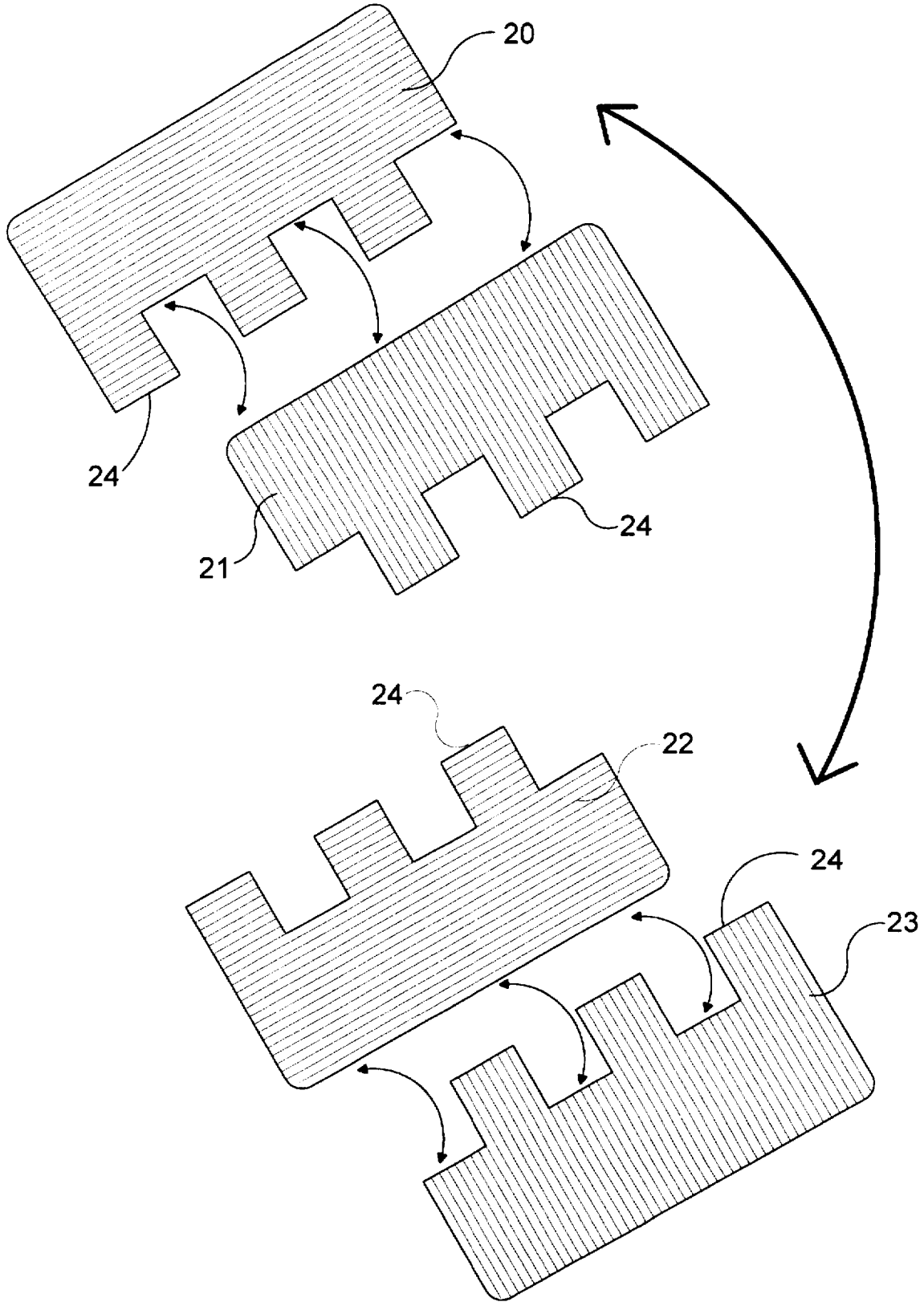
FIG. 2A shows one embodiment of the rigid panels, in a disassembled state, ready for shipment and assembly for insertion into the pockets of the Quickdrop.
Figure 2B:
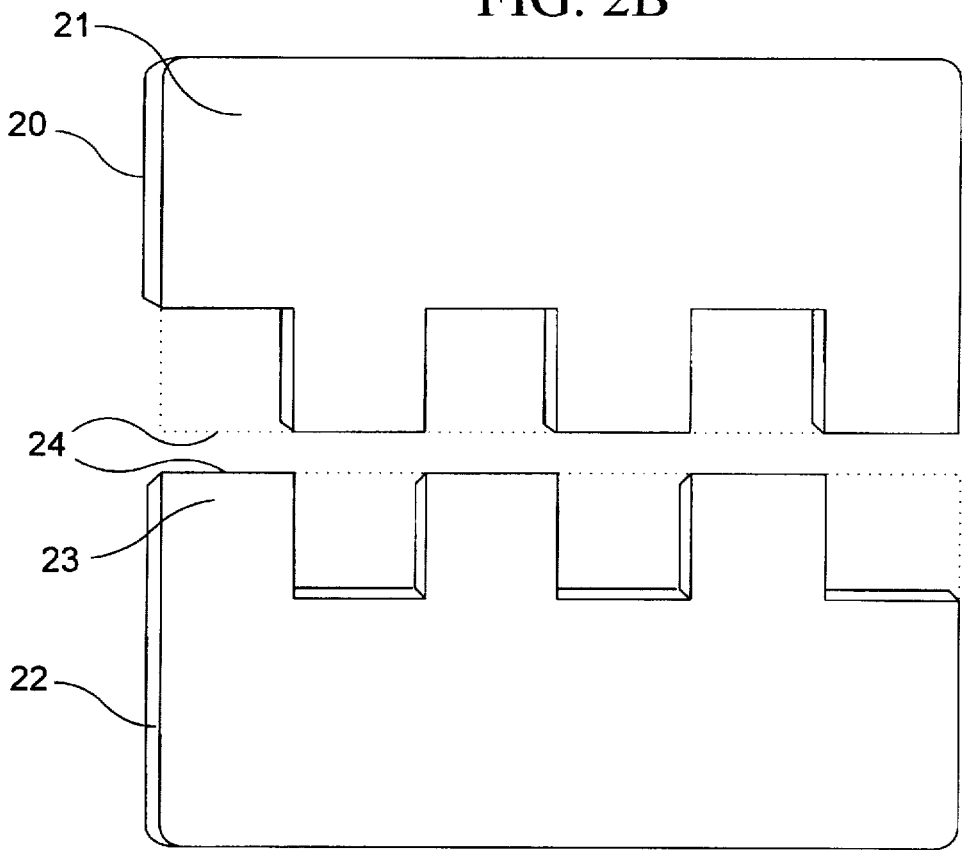
FIG. 2B shows the rigid panels in the next stage of assembly, ready for final assembly and insertion into the pockets of the Quickdrop.
Figure 2C:
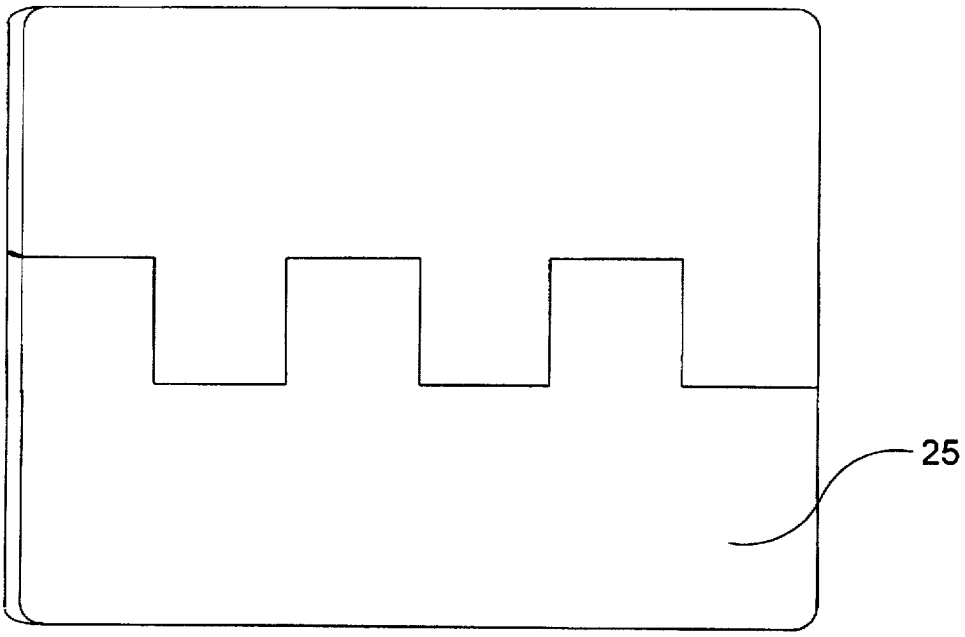
FIG. 2C shows the assembled rigid panels, ready for insertion into the pockets of the Quickdrop.

Referring now to FIG. 2A, there is provided four subsections 20, 21, 22, 23 of a flat rigid material, each cut in such a way as to have a serrated or toothed edge 24. Each tooth or serration preferably is about 6 inches across. Each subsection preferably has dimensions of about 21 inches (1 ft. 9 in.) by 36 inches (3 ft.). For cost purposes, this material is preferably a rigid cardboard, with the corrugations of sections 20 and 21, and those of sections 22 and 23 preferably being perpendicular to each other, thereby forming a web-like pattern in the corrugations when subsections 20 and 21 are bonded to each other, and subsections 22 and 23 are bonded to each other. The thus bonded subsections provide increased rigidity. In this fashion, sections 20 and 21 may be affixed to each other, and sections 22 and 23 may be affixed or bonded to each other, by gluing, stapling, riveting or like methods known in the art. As a result, two sections, one made of subsections 20 and 21 and the other made of subsections 22 and 23 are prepared, as shown in FIG. 2B. The teeth or serrations 24 of these sections may now be brought together in a tongue and groove format to form the interlocked, assembled rigid member 25 shown in FIG. 2C. The rigid member 25 preferably has dimensions of about 36 inches by 36 inches (3 ft.×3 ft.). A rigid member 25 prepared as described above, may be inserted into each of the pockets 12 and 13 of the partially assembled Quickdrop 15 to make the fully assembled Quickdrop 30 of this invention, shown in FIG. 3. The easy removal of the rigid sections is desirable as this allows washing of the fabric portion of the Quickdrop.

It should be noted that the foregoing description of the rigid member 25 is one preferred embodiment from the perspective of reduced cost, ease of manufacture, and ease of shipment. However, any flat rigid member of the necessary dimensions for insertion into the pockets 12 and 13 could be used, without any need for assembly. Thus, simple cardboard sections of dimension about 36 inches by 36 inches could be used. Alternatively, rigid aluminum or other metal, wood, plastic, fiberglass, plexiglass or like synthetic materials of the appropriate dimensions could be used.

These could be used either as single sections or as subsections which could be assembled in a fashion similar to that described above for the cardboard subsections.

Figure 3A:
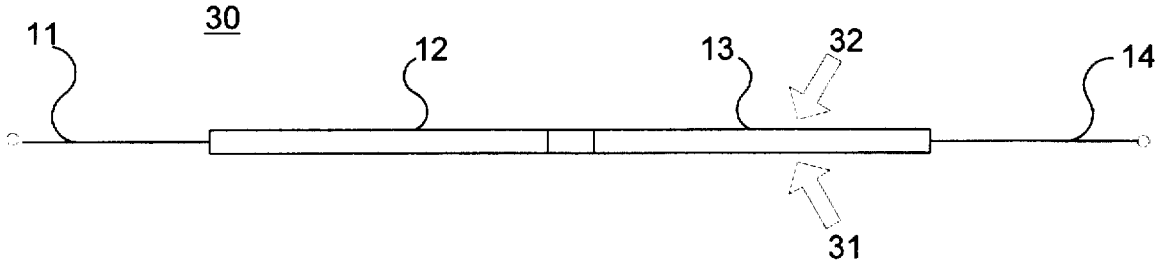
FIG. 3A–E shows a side view of the device as deployed and the method of folding for stowage.
Figure 3B:
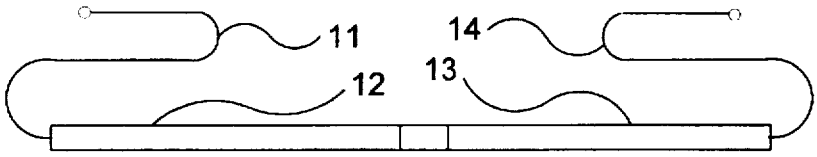
Figure 3C:
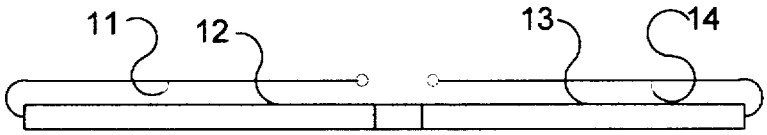
Figure 3D:
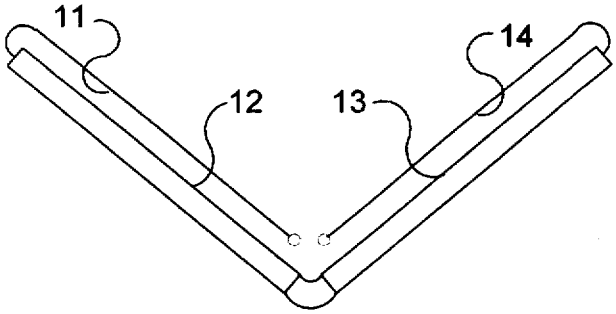
Figure 3E:
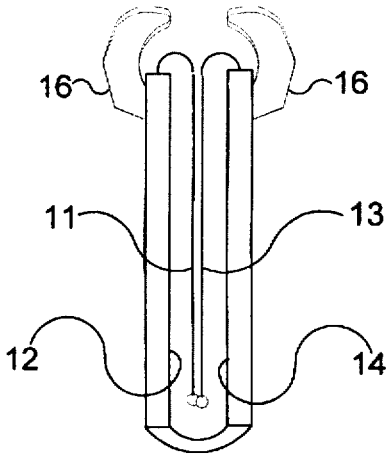

Referring now to FIG. 3A, the fully assembled and deployed Quickdrop 30 is shown in its most extended form. The dry 31 and wet 32 surfaces are emphasized. In FIG. 3B, a reduced amount of extension of the flexible quadrants 11 and 14 is shown. The continued contact of only wet to wet surfaces is evident. It can be seen that by proper folding of the quadrants 11 and 14, from 143 inches down to about 73 inches of coverage can be provided. In addition, if quadrant 12 is first folded onto quadrant 13, and each of quadrants 11 and 14 are only folded out to the extent needed to protect the dryness of the folded rigid quadrants, a coverage of about 36 inches can be achieved. Referring to FIG. 3C, the quadrants 11 and 14 are shown folded onto quadrants 11 and 12, with only wet surfaces making contact with each other. In FIG. 3D, it can be seen how the two halves of the Quickdrop are folded toward each other. In FIG. 3E, the fully closed Quickdrop is shown. In this state, the device is easily movable or transportable. To assist in easy transport, in a preferred embodiment, there is optionally provided a handle, 16, made of cloth, plastic, leather or any other suitable material, on the underside of each half of the folded Quickdrop.

The foregoing description provides details on the preparation and use of a large Quickdrop device. In similar fashion, a smaller embodiment of the Quickdrop, referred to herein as the Minidrop or Closetdrop, can be made with the following dimensions:

Dropcloth: 79 inches (6 ft. 7 in.) long×20 inches (1 ft. 8 in.) wide, (starting from a single piece of fabric of about 82 inches×43 inches).

Rigid panels: 20 inches×20 inches.

Dowels: 20 inches×¼ inch in diameter.

The exemplary dimensions given above for the Quickdrop and Closetdrop are preferred because the average splatter zone during a painting operation is about 32 inches out from a wall. Over 95% of paint specs fall within this zone. Thus, with dimensions of 36 inches, up to about 99% coverage is provided. A length of about 11 ft., 11 inches is preferred for the Quickdrop because the average bedroom is about 12 ft.×12 ft., thus allowing coverage of an entire wall without the need to move or adjust the Quickdrop. In addition, if the wall is longer, the paint source would need to be moved in any event. At the same time, the Quickdrop could be easily moved and replaced. The preferred Closetdrop dimensions are chosen so as to maximize protective coverage, while at the same time enhancing the maneuverability of the drop-cloth.

The collapsibility of the panels of the Quickdrop serves as a convenient method for packaging and storing the Quick-drop. By allowing the painter to remove panels and then separate panels, the size can be reduced from 36 inches×36 inches to 21 inches×36 inches (about a 42% reduction in size).

Use of dowels in the fold-out flaps allows for full control of the flexible flaps, even with one hand. In addition, upon folding the flaps inwardly for storage or movement from one location to another, the weight and rigidity of the dowels assist in forcing the flaps to fall evenly to the center of the Quickdrop. This also forces the wet sides of the Quickdrop to contact each other, preventing soiling of dry surfaces of the Quickdrop and of non-workpiece items.

The rigidity of the Quickdrop is one of the key aspects to the improved utility of this device over those previously used in the art. By having central panel(s) which are rigid, folding of the cloth over onto itself and onto the floor or other non-workpiece items, is prevented. Laymen and experienced painters alike will find this device to be a great time and labor saver as the need to clean paint smears from carpeting, the floor or other non-workpiece items will be eliminated. In addition, the rigidity of the Quickdrop allows easy placement and replacement, even with a single hand, during the painting operation. In addition, the flexible flaps or quadrants of the Quickdrop allow for full adjustability of the protective surface from about 36 inches to about 143 inches, depending on how the flaps are folded out.

While the foregoing description has provided specific details about the methods of making and using the Quick-drop of the instant invention, including its best mode, those skilled in the art will recognize that alterations and modifications thereof come within the scope of the invention as claimed hereinbelow.

References

Osborn, Paul V., U.S. Pat. No. 4,682,447, issued Jul. 28, 1987.

Couch, Robert L., U.S. Pat. No. 4,031,589, issued Jun. 28, 1977.

Elyea, Charles M., U.S. Pat. No. 3,872,549, issued Mar. 25, 1975.

We claim:

1. A device to prevent soiling or splatter by paint of a non-workpiece item during the painting of a workpiece which comprises:

(a) a protective fabric having a working surface which is interposed between the workpiece being painted and an underside which is placed facing the non-workpiece item during the painting of a said workpiece;

(b) at least one substantially flat rigid member to which said protective fabric is affixed, either by containing said rigid member within a pocket formed from said protective fabric or by said rigid member being affixed to the underside of said protective fabric, and wherein the area of said substantially flat rigid member substantially matches the area of the protective fabric to which it is affixed; and (c) at least one flexible section or flap of said protective fabric extending from said rigid member.

2. The device of claim 1 comprising two rigid members.

3. The device of claim 2 comprising two flexible flaps or sections.

4. The device of claim 1 wherein an outer aspect of said flexible flap or section is affixed to a rigid rod.

5. The device of claim 1 wherein said protective fabric comprises cloth, plastic, material with a liquid impermeable backing or woven tarpaulin material.

6. The device of claim 1 wherein said rigid member comprises cardboard, wood, plastic, or metal.

7. The device of claim 6 in which the rigid panel comprises sections of bonded cardboard, each section having corrugations perpendicularly offset from the section to which it is bonded.

8. The device of claim 7 in which the rigid panel has two halves which may be assembled or disassembled.

9. The device of claim 8 in which the two halves of said rigid panel can be assembled and disassembled by means of interlocking tongue and groove edges.

10. The device of claim 1 comprising:

(a) a protective fabric having a working surface and an underside;

(b) two rigid members to which said protective fabric is affixed, either by containing said rigid member within a pocket formed from said protective fabric or by said rigid member being affixed to the underside of said protective fabric, thereby forming two rigid sections which are hingedly connected to each other by a flexible portion of said protective fabric; and (c) two flexible sections or flaps of said protective fabric extending from the edge of each of said rigid sections and which can be folded out from and into the center of said rigid sections.

11. The device of claim 10 wherein each of said flexible section has a rigid rod affixed to its outermost aspect.

12. The device of claim 10 having a total, folded out length of about 143 inches, and a width of about 3 feet.

13. The device of claim 10 having a total, folded out length of about 79 inches, and a width of about 20 inches.

14. The device of claim 10 wherein said flexible sections and said rigid sections can be easily separated and re-attached to each other.

15. The device of claim 14 in which said flexible sections can be separated and re-attached to each other by means of hook and loop material, zipper or snaps.

16. The device of claim 10 further comprising a disposable protective sheet for use in preventing soiling of the device.

17. The device of claim 10 further comprising a handle for easily transporting the device in a fully folded state.

* * * * *

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

Column 3, line 49: "Velcro hook and loop" should read --hook and loop--.

Column 5, line 58 - Column 6, line 10, Claim 1:

"A device to prevent soiling or splatter by paint of a non-workpiece item during the painting of a workpiece which comprises:

(a) a protective fabric having a working surface which is interposed between the workpiece being painted and an underside, which is placed facing the non-workpiece item during the painting of a said workpiece;

(b) at least one substantially flat rigid member to which said protective fabric is affixed, either by containing said rigid member within a pocket formed from said protective fabric or by said rigid member being affixed to the underside of said protective fabric, and wherein the area of said substantially flat rigid member substantially matches the area of the protective fabric to which it is affixed; and (c) at least one flexible section or flap of said protective fabric extending from said rigid member." should read

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

-- A device to prevent soiling or splatter by paint of a non-workpiece item during the painting of a workpiece which comprises:

(a) a protective fabric having a working surface and an underside, said protective fabric defining a fixed area of coverage to cover a proportionate area of said non-workpiece item;

(b) at least one flat rigid panel to which said protective fabric is affixed, either by containing said rigid panel within a pocket formed from said protective fabric or by said rigid panel being affixed to the underside of said protective fabric, and wherein the area of said flat rigid panel substantially matches the fixed area of coverage of the protective fabric to which it is affixed; and (c) at least one flexible section of said protective fabric extending from at least one side of said fixed area of coverage to selectively increase said fixed area of coverage in an amount less than or equal to the area of said flexible section; whereby the amount of protection provided by said protective fabric can be selectively increased from said fixed area of coverage up to said fixed area of coverage plus the area of said flexible section.--

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

Column 6, line 11, Claim 2:

"The device of claim 1 comprising two rigid members." should read

--The device of claim 1 comprising two flat rigid panels, the combined area of which together substantially match the fixed area of coverage of the protective fabric and allow said protective fabric to be folded substantially in half with said rigid panels affixed.--

Column 6, lines 12-13, Claim 3:

"The device of claim 2 comprising two flexible flaps or sections." should read

--The device of claim 2 comprising two flexible sections extending from opposite sides of said fixed area of coverage.--

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

Column 6, lines 14-15, Claim 4:

"The device of claim 1 wherein an outer aspect of said flexible flap or section is affixed to a rigid rod." should read --The device of claim 1 wherein an outer aspect of said flexible section is affixed to a rigid rod.--

Column 6, lines 20-21, Claim 6:

"The device of claim 1 wherein said rigid member comprises cardboard, wood, plastic, or metal." should read --The device of claim 1 wherein said rigid panel comprises cardboard, wood, plastic or metal.--

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

Column 6, lines 31-45, Claim 10:

"The device of claim 1 comprising:

(a) a protective fabric having a working surface and an underside;

(b) two rigid members to which said protective fabric is affixed, either by containing said rigid member within a pocket formed from said protective fabric or by said rigid member being affixed to the underside of said protective fabric, thereby forming two rigid sections which are hingedly connected to each other by a flexible portion of said protective fabric; and (c) two flexible sections or flaps of said protective fabric extending from the edge of each of said rigid sections and which can be folded out from and into the center of said rigid sections." should read

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

--A device to prevent soiling or splatter of a non-workpiece item during the painting of a workpiece comprising:

(a) a protective fabric having a working surface and an underside, said protective fabric defining a fixed area of coverage to cover a proportionate area of said non-workpiece item;

(b) two flat rigid panels to which said protective fabric is affixed, either by containing said rigid panel within a pocket formed from said protective fabric or by said rigid panel being affixed to the underside of said protective fabric, thereby forming two rigid sections which are hingedly connected to each other by a flexible portion of said protective fabric, wherein the area of said flat rigid panels combined substantially matches the fixed area of coverage of the protective fabric; and

UNITED STATES PATENT AND TRADEMARK OFFICE

CERTIFICATE OF CORRECTION

PATENT NO. : 5,761,853

DATED : June 9, 1998

INVENTOR(S) : Stephen Trosper and Frederick Taylor

It is certified that error appears in the above-identified patent and that said Letters Patent is hereby corrected as shown below:

(c) two flexible sections of said protective fabric extending from opposite sides of said fixed area of coverage and which can be folded out from and into the center of said rigid sections whereby the amount of protection provided by said protective fabric can be selectively increased from said fixed area of coverage up to said fixed area of coverage plus the area of said flexible section.--

Signed and Sealed this

Twenty-seventh Day of April, 1999

*Attest:*

Q. TODD DICKINSON

*Attesting Officer*

*Acting Commissioner of Patents and Trademarks*